US011680719B1

(12) United States Patent
Browne et al.

(10) Patent No.: US 11,680,719 B1
(45) Date of Patent: Jun. 20, 2023

(54) EXHAUST FAN ASSEMBLY

(71) Applicants: David Browne, Fort Pierce, FL (US); Holly Raboy, Fort Pierce, FL (US)

(72) Inventors: David Browne, Fort Pierce, FL (US); Holly Raboy, Fort Pierce, FL (US)

( * ) Notice: Subject to any disclaimer, the term of this patent is extended or adjusted under 35 U.S.C. 154(b) by 32 days.

(21) Appl. No.: 17/200,049

(22) Filed: Mar. 12, 2021

Related U.S. Application Data

(60) Provisional application No. 63/100,418, filed on Mar. 12, 2020.

(51) Int. Cl.
*F24F 7/013* (2006.01)
*F24F 13/02* (2006.01)
*F24F 7/00* (2021.01)

(52) U.S. Cl.
CPC ..... *F24F 7/013* (2013.01); *F24F 13/0209* (2013.01); *F24F 13/0227* (2013.01); *F24F 13/0254* (2013.01); *F24F 2007/001* (2013.01)

(58) Field of Classification Search
CPC ..... F24F 7/013; F24F 2221/20; F24F 3/0209; F24F 3/0227; F24F 3/0254
USPC ..... 454/208, 189, 195, 197, 200, 203, 204, 454/50, 68
See application file for complete search history.

(56) References Cited

U.S. PATENT DOCUMENTS 2,191,418 A * 2/1940 Allen ..... F04D 29/646 454/200
2,548,327 A * 4/1951 Spear ..... F24F 7/013 454/212
3,096,933 A * 7/1963 Bora ..... F04D 29/646 417/247
9,776,223 B2 * 10/2017 Rankin ..... B08B 15/02

OTHER PUBLICATIONS

Gulrear (https://www.amazon.com/gulrear-Sliding-Conditioner-Adjustable-5-1Inch/dp/B0836RPM1P?th=1, first available in 2019) (Year: 2019).*
"Plywood H-clip" (https://www.amazon.com/Plywood-Clip-15-32-Sheathing/dp/B07L9GV768/ref=sr_1_3?crid=11XMFF6WA8SM6&keywords=hclip&qid=1658788859&sprefix=h-cli%2Caps%2C169&sr=8-3&th=1#customerReviews, earliest review in 2019). (Year: 2019).*
Photograph of a fan used by one inventor in 1994.

* cited by examiner

*Primary Examiner* — Vivek K Shirsat
(74) *Attorney, Agent, or Firm* — William F. Lang, IV; Lang Patent Law LLC

(57) ABSTRACT

An exhaust fan includes a generally square housing, adjustable-height supports, and attachments for a variety of air ducts. The air ducts are each designed to provide a sufficient air seal to effectively enable the exhaust fan to evacuate dust and debris from a wide variety of standard doors or windows, either on the ground floor or an elevated floor.

6 Claims, 18 Drawing Sheets

EXHAUST FAN ASSEMBLY

CROSS REFERENCE TO RELATED APPLICATION

This application claims the benefit of U.S. provisional patent application Ser. No. 63/100,418, which was filed on Mar. 12, 2020, and entitled "Portable Fan Assembly Clean Air."

TECHNICAL FIELD

The present invention relates to exhaust fans for construction. More specifically, an assembly of an exhaust fan and a variety of particle channeling attachments is provided for use in removing dust and other particles through a variety of pre-existing building openings.

BACKGROUND INFORMATION

Building construction, renovation, and repair invariably generates large quantities of dust and other particles. These particles create significant cleaning difficulties during and after the completion of work, and depending on the nature of the particles, could potentially raise health concerns. Any dust or other particles that are not removed can infiltrate the entire structure.

Exhaust fans have been used to remove such dust and other particles. However, prior exhaust fans typically consist of a fan permanently mounted in a pre-existing building opening. Without portability to move the fan to different locations that must be exhausted, and without any panels or air channels to channel air through the fan, effectiveness is limited to the specific permanent mounting location. Placing a portable fan in a pre-existing doorway without taking additional steps to provide for use of the doorway hinders entry and exit during work. Furthermore, placing the fan in an existing window or door, without taking steps to resist unauthorized entry, raises security concerns.

A wide variety of pre-existing building openings must be accommodated. Generally these openings will include windows or doors, but may also include other openings such as skylights and air conditioner receptacles. While some windows incorporate portions that slide up or down, other windows, such as casement windows, include portions that rotate inward or outward from the window frame. Not only is accommodating the position of the moving window portions essential, but maintaining security is also essential. Doors that may be in proximity to the work site may include hinged single or double doors, sliding doors, or garage doors. Each of these doors requires a different panel and/or duct structure in order to properly channel air, permit desired entry and egress, and resist undesired entry and egress (pets, for example). In many cases, attaching an exhaust fan to a window or door frame, adjacent wall, or the ground below the window or door may be limited by the nature of the window or door, the terrain below, and/or the need to resist damage to surrounding structures.

Accordingly, there is a need for an exhaust fan assembly that accommodates a wide variety of pre-existing building openings. There is a further need for an exhaust fan assembly that can be utilized in connection with a door while permitting desired entry and egress through that door. There is an additional need for an exhaust fan assembly that resists unauthorized entry and egress when in place. There is also a need for an exhaust fan assembly that includes a variety of means for securing the assembly to pre-existing building openings presenting a wide variety of limitations on how the assembly may be secured to the building opening.

SUMMARY

The above needs are met by an exhaust fan assembly, comprising a fan having a housing with an air inlet and an air exit. The fan assembly further comprises a plurality of air ducts, with each air duct being dimensioned and configured to fit between the air inlet of the housing and either a standard door or a standard window and to provide an exhaust-effective seal between the standard door or standard window and the air inlet of the housing.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
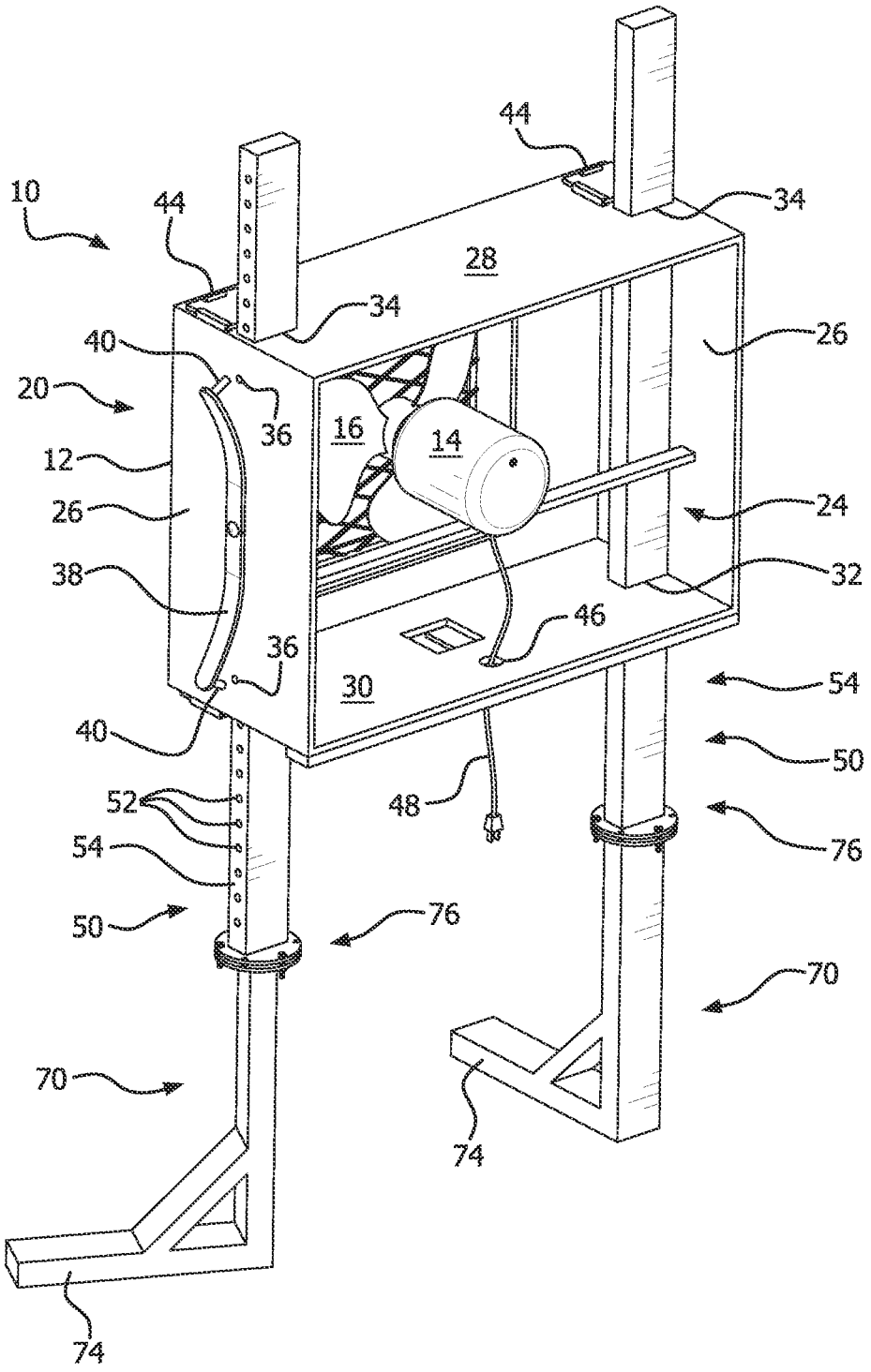
FIG. 1 is a perspective back view of an exhaust fan assembly including a pair of support legs.
Figure 2:
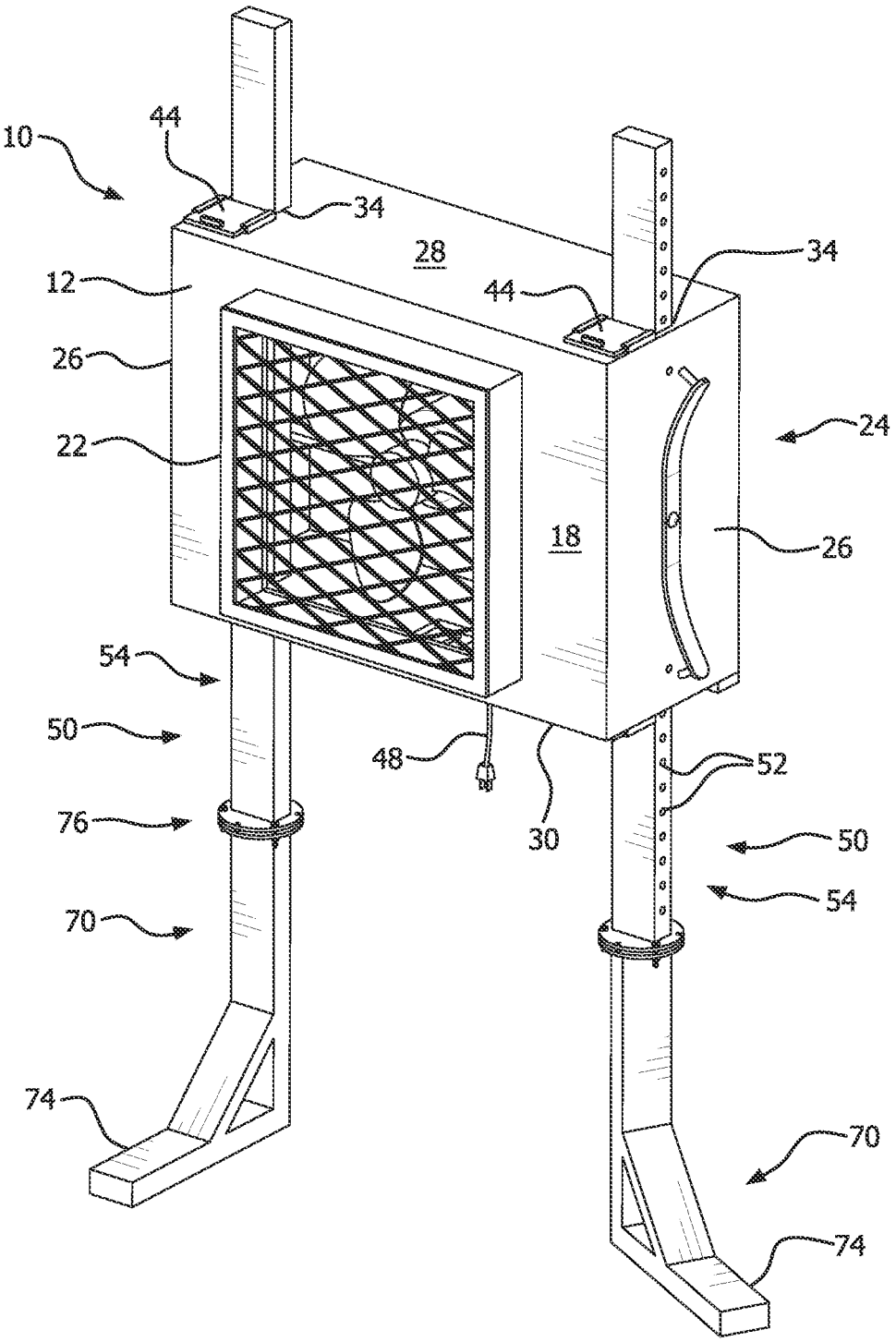
FIG. 2 is a perspective front view of the exhaust fan assembly of FIG. 1.
Figure 3:
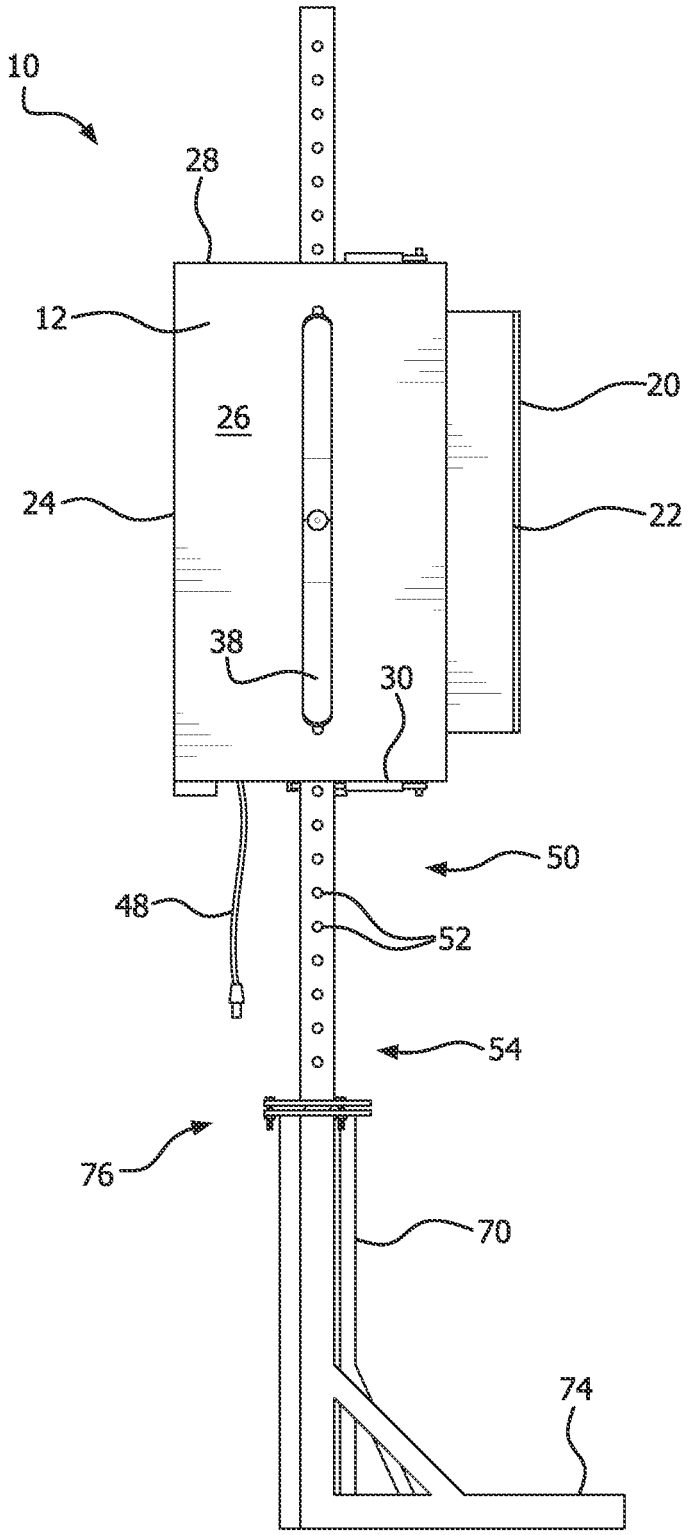
FIG. 3 is a side view of the exhaust fan assembly of FIG. 1.
Figure 4:
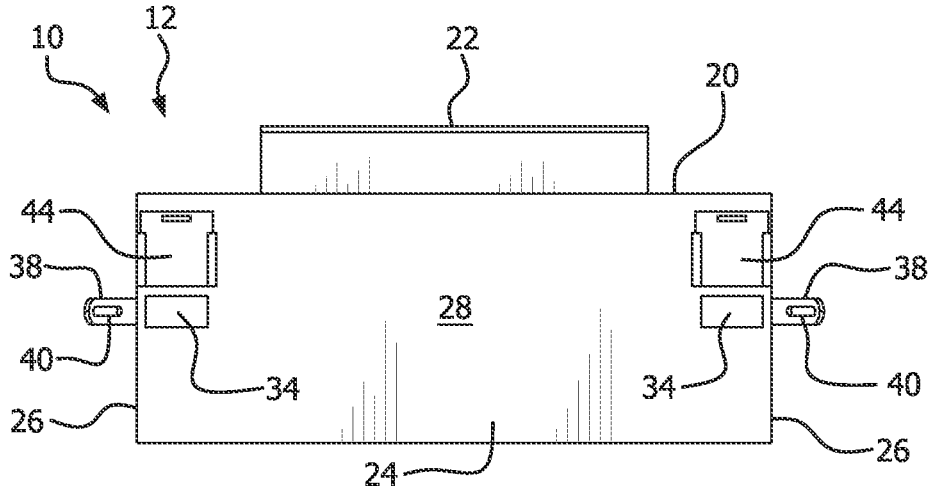
FIG. 4 is a top view of an exhaust fan of FIG. 1.
Figure 5:
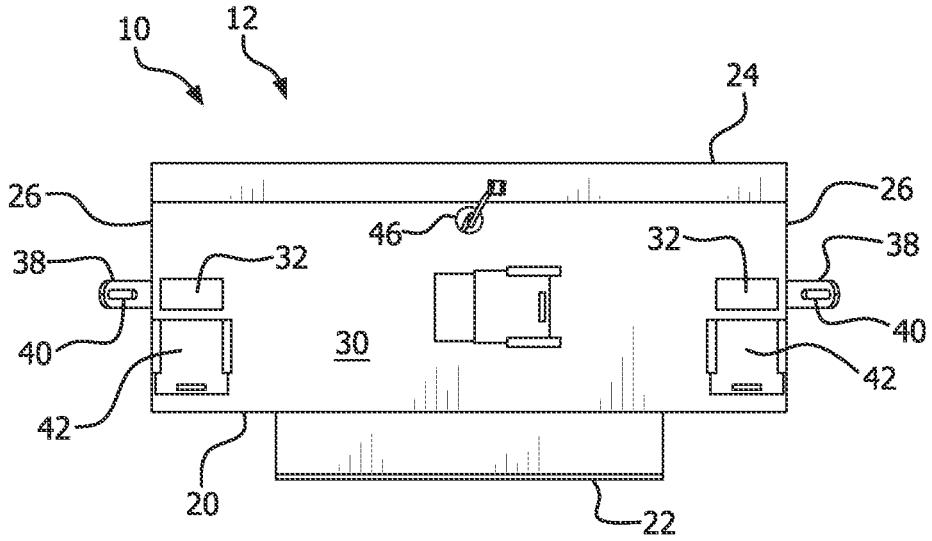
FIG. 5 is a top view of an exhaust fan of FIG. 1.

Referring to the drawings, an exhaust fan assembly is illustrated. The illustrated example of an exhaust fan assembly includes a fan, a support structure which removably attaches to the fan, and a variety of air ducts that connect between the fan and either a window or door of a house. When an air duct is positioned between the fan and a window or door, an exhaust-effective seal is provided between the fan and the window or door. An exhaust effective seal is not necessarily a perfect seal, but will sufficiently limit air flow through the fan to air flowing through the window or door so that dust and other debris is removed through the fan. As used herein, the terms top, bottom, front, back, and side are used for convenience of reference, since rotating an object will change the effective top, bottom, etc. As used herein, "substantially" means sufficiently close to accomplish the stated purpose.

Referring to FIGS. 1-5, the illustrated example of a fan 10 includes a housing 12 containing a motor 14 and fan blades 16 (which are well known to those skilled in the art), which in the illustrated example is substantially square when viewed from either the front (outlet) 14 or back (intake) 16. In the illustrated example, the fan 10 is capable of producing an air flow of between about 50 cubic feet per minute and about 10,000 cubic feet per minute. The illustrated example of the front 20 includes a screen 22 to permit the passage of air therethrough. The illustrated example of a back 24 is open, although some examples of the back 24 may include a screen. The housing 12 also includes a pair of sides 26, a top 28, and a bottom 30. The illustrated example of a housing defines a pair of openings 32 within the bottom 30, as well as openings 34 within the top 28 which are vertically aligned with the openings 32 to permit the passage of vertical frame member (described in greater detail below) therethrough. Some examples may include a tube extending from each opening 32 to the corresponding opening 34, thus resisting the entry of water into the housing 12 through the openings 34. A pair of holes 36 are defined within each side 26. A strap 38, which in the illustrated example is made from spring steel, is fastened to each side 26, and includes a pin 40 at each end, corresponding to one of the holes 36. Covers 42 may be provided for the openings 32, and covers 44 may be provided for the openings 34. In the illustrated example, the covers 42,44 slide over the openings 32,34 when not in use. Other examples may use hinged covers, detachable covers, or any other cover that can be used to selectively cover and uncover the openings 32,34. Some examples of the housing 12 may include a cord receptacle 46 for receiving a retractable cord 48, as well as a sliding panel 48 to control the strength of the air exhausting force provided by the fan 10. Handles may be provided for facilitating transportation and setup of some examples of the exhaust fan 10.

The support frame includes a pair of legs 50. Each of the legs 50 are structured to fit through one set of corresponding openings 32, 34. In some examples, apertures 52 defined within the sides 54 of the legs 50 are structured to receive pins 40 projecting from the straps 38. The housing 12 can thus be set at an appropriate height, and the pins 40 inserted through the holes 36 in the housing 12 as well as the holes 52 to hold the housing 12 at the desired height.

Figure 6:
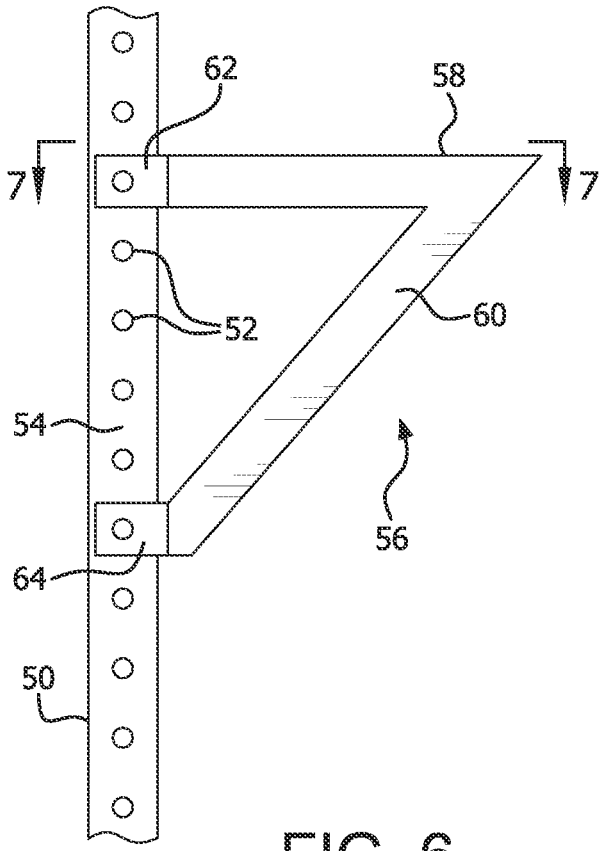
FIG. 6 is a side elevational view of a cross brace for a support frame.
Figure 8:
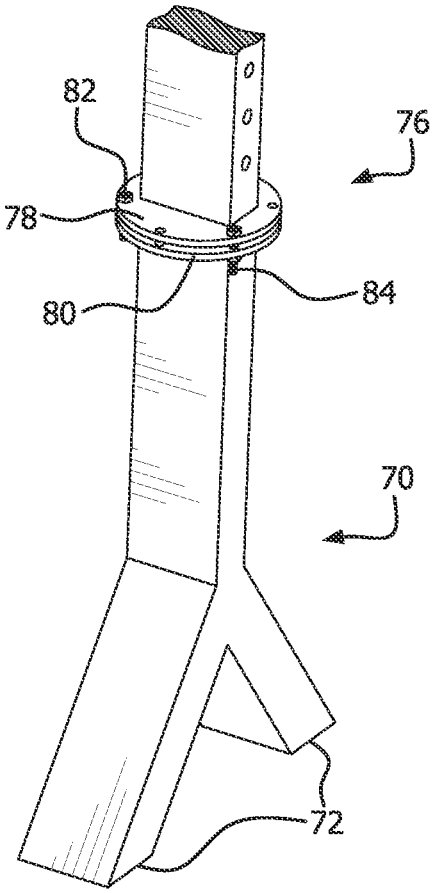
FIG. 8 is a side elevational view of an alternative foot for a support leg.
Figure 7:
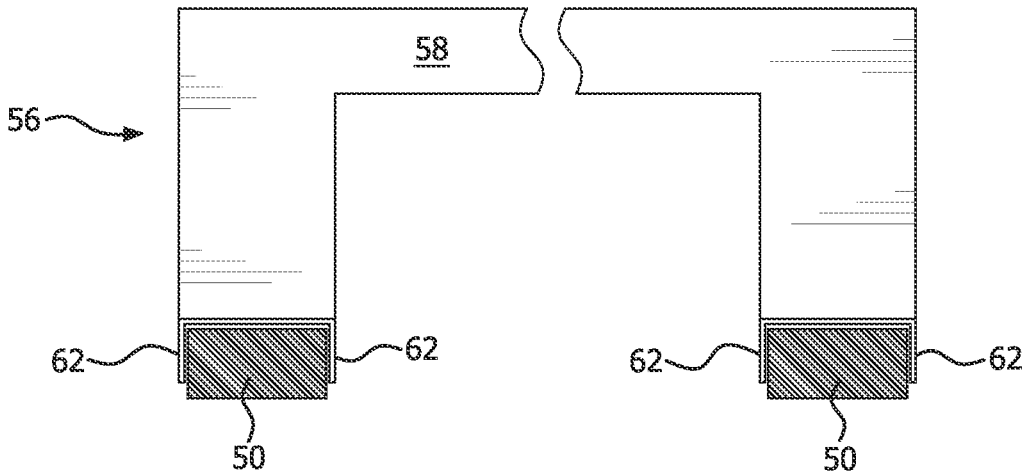
FIG. 7 is a top plan view of a cross brace for a support frame.
Figure 9:
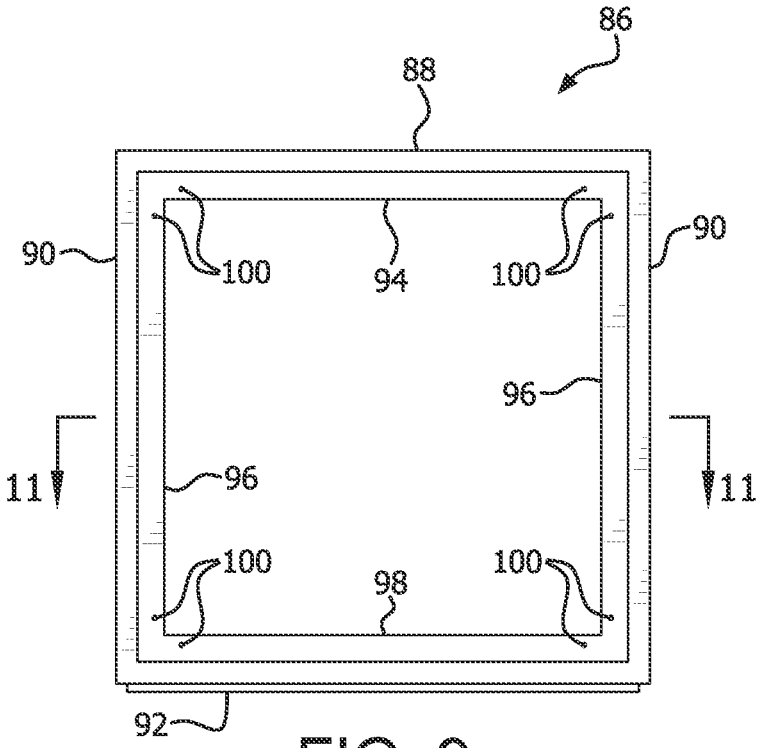
FIG. 9 is a front elevational view of a window duct for an exhaust fan.
Figure 10:
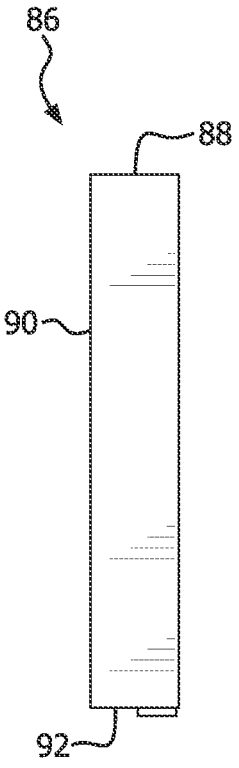
FIG. 10 is a side elevational view of the window duct of FIG. 6.
Figure 11:
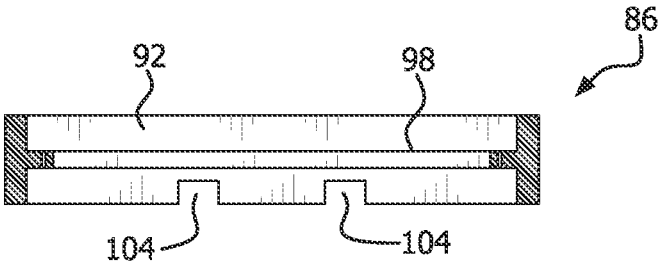
FIG. 11 is a cross sectional view of the widow duct of FIG. 6, taken along the lines A-A in FIG. 6.

Referring to FIGS. 6-8, some examples of the support frame include a cross leg stabilizer 56. The cross leg stabilizer 56 includes a substantially horizontal shelf 58 extending between the legs 50, and an angled brace member 60 extending downward from the horizontal shelf 58 to each of the legs 50. Both of the shelf 58 and angled brace members 60 are secured to the legs 50 in a manner that permits vertical adjustment of the position of the cross leg stabilizer 56 with respect to the legs 50. In the illustrated example, the shelf 56 includes a pair of attachment flanges 62 extending on either side of each of the legs 50. Similarly, the angled brace 60 includes a pair of attachment flanges 64 extending on either side of each of the legs 50 in a manner that is substantially identical to that of the flanges 62. In the illustrated example, any type of conventional fastener, such as a nail, screw, or bolt, may pass through holes 66, 68 in the flanges 62, 64, respectively as well as the hole 52 within the leg 50 therebetween. Some examples of the housing 12 of the fan 10 are supported at the appropriate height by resting the fan 10 on the cross leg stabilizer 56. The bottom end of each of the legs 50 is connected to a base 70, which in some examples includes a pair of legs 72 forming an upside down "v", and in other examples may include a horizontal base member 74. The Y-shaped legs 72 and horizontal base 74 are completely interchangeable, and any example that is illustrated with one may use the other. In either case, some examples of the base 70 are joined to the leg 50 through a pivot assembly 76 (FIG. 3), having a central pivot, and upper plate 78, and a lower plate 80. Each of the upper plate 78 and lower plate 80 defines apertures 82 therein. A bolt 84 may be placed through a pair of apertures 82 to secure the base 70 in a desired rotational position, with a nut secured to the end of the bolt 84.

Figure 12:
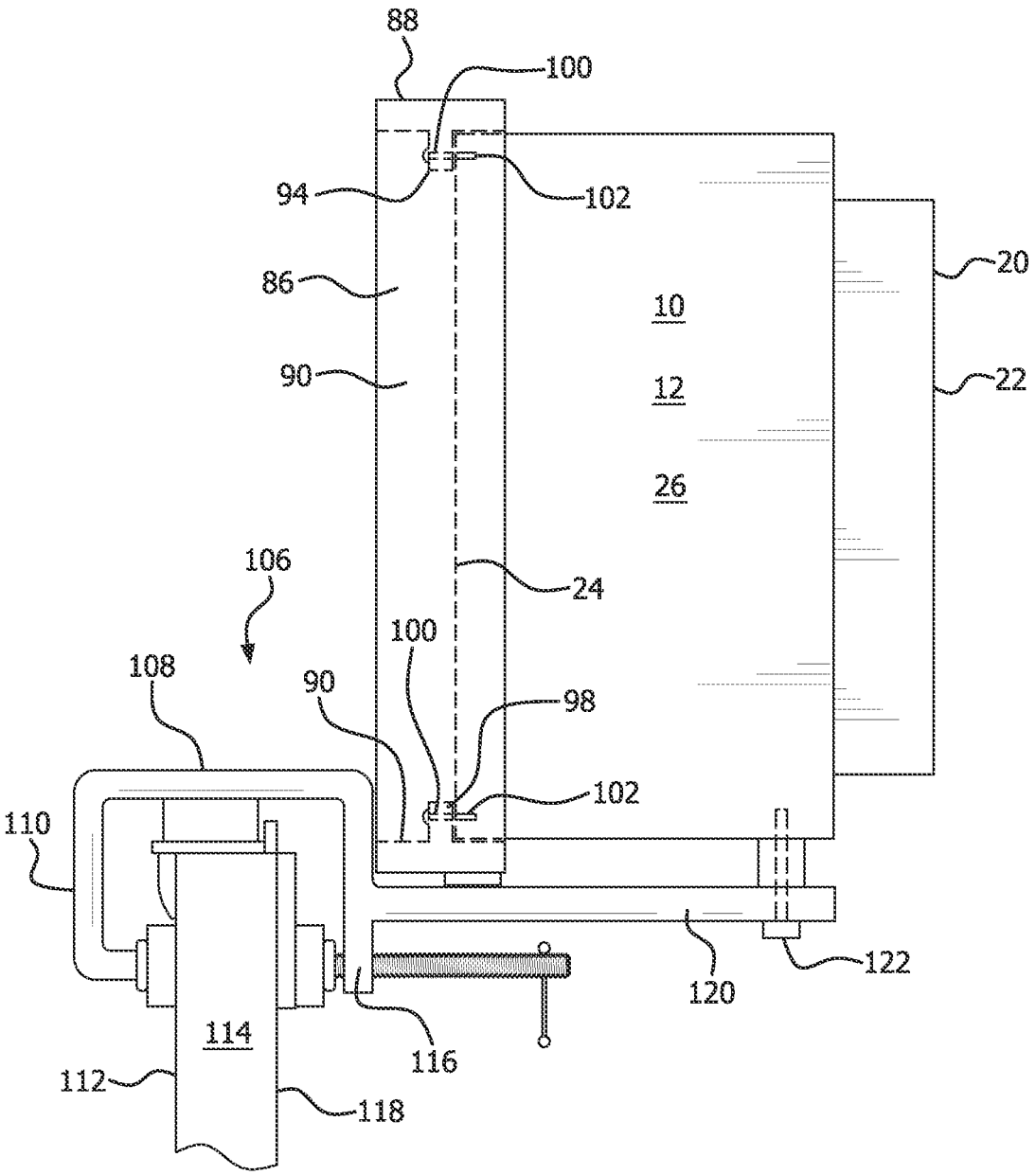
FIG. 12 is a side elevational view of an exhaust fan in connection with a window duct and an attachment for securing the exhaust fan to a window frame.

Referring to FIGS. 9-12, the fan 10 can be secured to or adjacent to a window frame, in addition to or as an alternative to supporting the fan 10 using the support frame. A window duct 86 is secured around the front portion 20 of the fan 10. The window duct 86 includes a top 88, sides 90, and a bottom 92 extending around the sides 26, top 28, and bottom 30 of the fan 10. An attachment flange 94, 96, 98 extends inward from a central portion of each of the top 88, side 90, and bottom 92 panels, so that the flange 94, 96, 98 extends around substantially the entire circumference of the window duct 86. Holes 100 within the flanges 94, 96, 98 facilitate bolting or screwing the window duct 86 to the front 20 of the housing 12 using fasteners 102 (FIG. 12). Cutouts 104 (FIG. 11) provide space for window clamps to secure the fan 10 to a window frame as illustrated in FIG. 12. As shown in FIG. 12, each clamp 106 includes a frame 108, a fixed clamping arm 110 which in the illustrated example fits against the interior 112 of the window frame 114, and an adjustable clamp arm 116 which in the illustrated example fits against the exterior 118 of the window frame 114. A clamp mount 120 extends underneath the fan 10, and is secured to the fan 10 by bolts or screws 122. The fan 10 may thus be secured against the exterior of the window without the need for a support resting on the ground, and without creating additional holes within the wall or window frame to support the fan. Air is channeled through the window duct 86, ensuring that dust is exhausted through the fan 10. If desired, wood may be placed between the clamp 106 and the window frame 114 to resist damage to the window frame 114.

Figure 13:
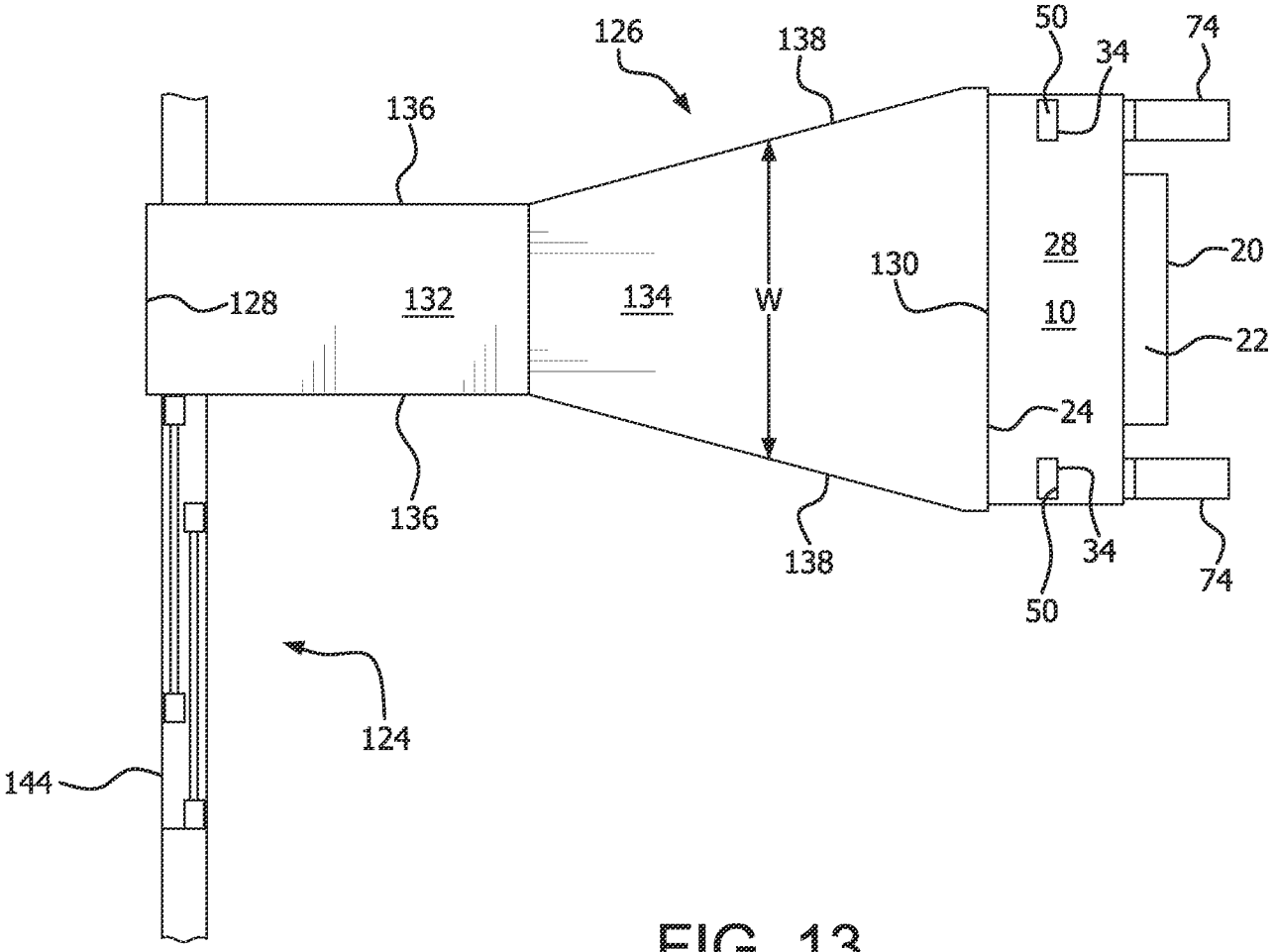
FIG. 13 is a top plan view of a duct for an exhaust fan for use with a sliding door.
Figure 14:
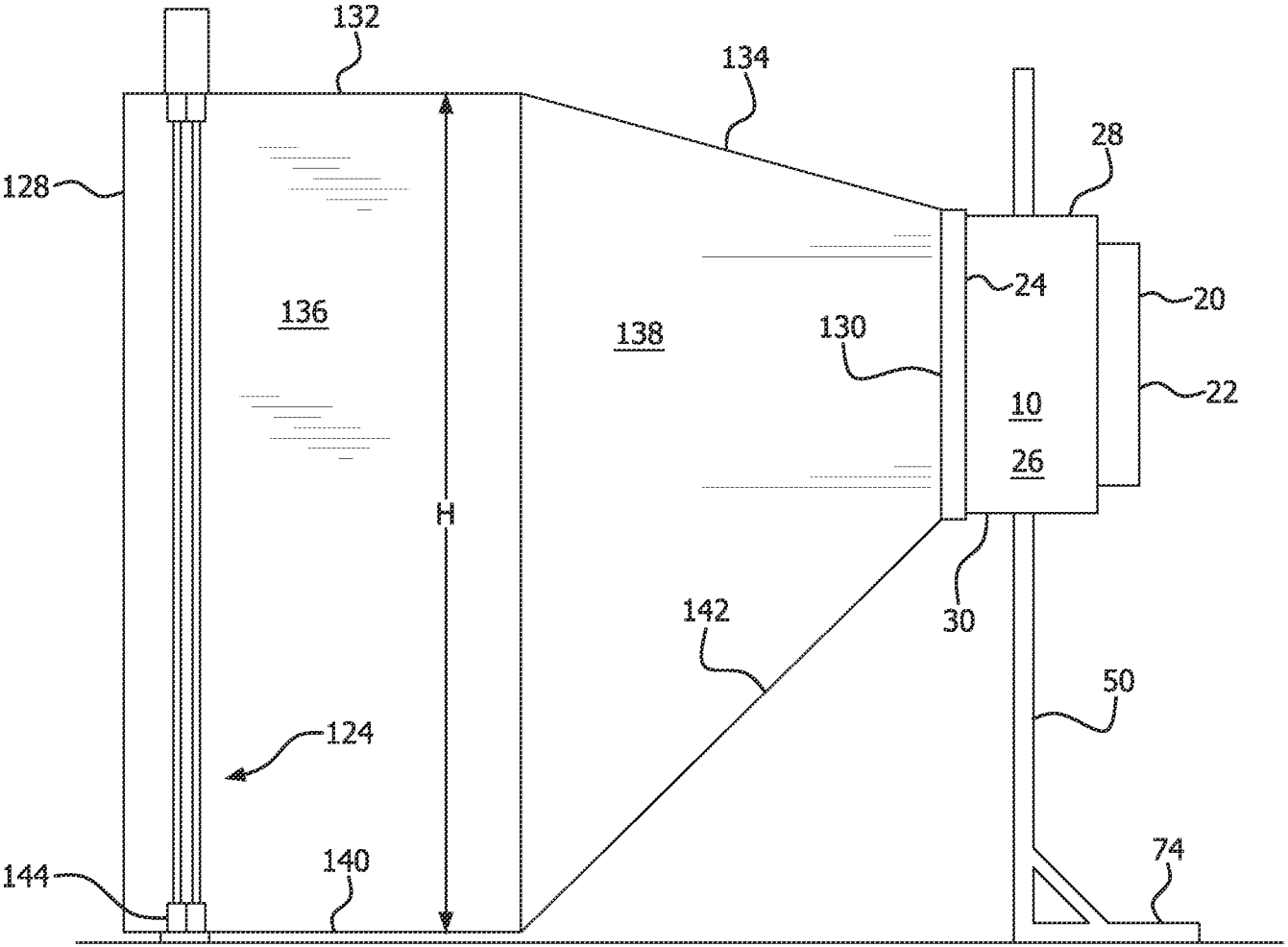
FIG. 14 is a side elevational view of the duct of FIG. 13.

Referring to FIGS. 13-14, in some instances, it may be desirable to utilize the exhaust fan 10 in convention with a conventional sliding door, for example, the sliding glass door 124, which is a typical residential patio door. In this instance, the fan 10 is used in connection with a sliding door air duct 126. The sliding door air duct 126 includes a high, narrow entrance 128, which in the illustrated example is about 12 inches wide by about 82 inches high, matching the height of a typical sliding glass door 124, but occupying only a small portion of the width of the door 124. The air duct 126 tapers in height H and widens in width W so that the outlet 130 corresponds to the dimensions of the fan 10. The entire back 24 surface area of the fan 10 is thus available to provide exhaust force, without limiting airflow throughout the air duct 126. Additional panels may be provided to completely seal different size doors. For example, an additional panel may be placed above the air duct 126 in the case of a taller door 128. Alternatively, a larger panel may be placed alongside the air duct 126 if entry and exit through the sliding glass door is not desired. The outlet 130 of the air duct 126 is secured around the fan 10. The fan 10 can be supported by support legs 50 as described above. Each of the top 132,134, side 136,138, and bottom 140,142 panels of some examples of the air duct 126 are fastened together in a manner permitting assembly for use and disassembly for transport, for example, by threaded fasteners such as bolts or screws.

With the air duct 126 in place, air and dust can be exhausted through the sliding glass door 124, without preventing use of the sliding glass door 124 as an entrance or exit. A sufficient seal is provided with the sliding door 124 closed against the entrance 128. Briefly opening the sliding glass door 124 permits entrance and exit adjacent to the air duct 126. An appropriately sized stick dropped in the channel 144 of the sliding glass door 124 resists opening of the sliding glass door 124 for security at night, or at other desired times.

Figure 15:
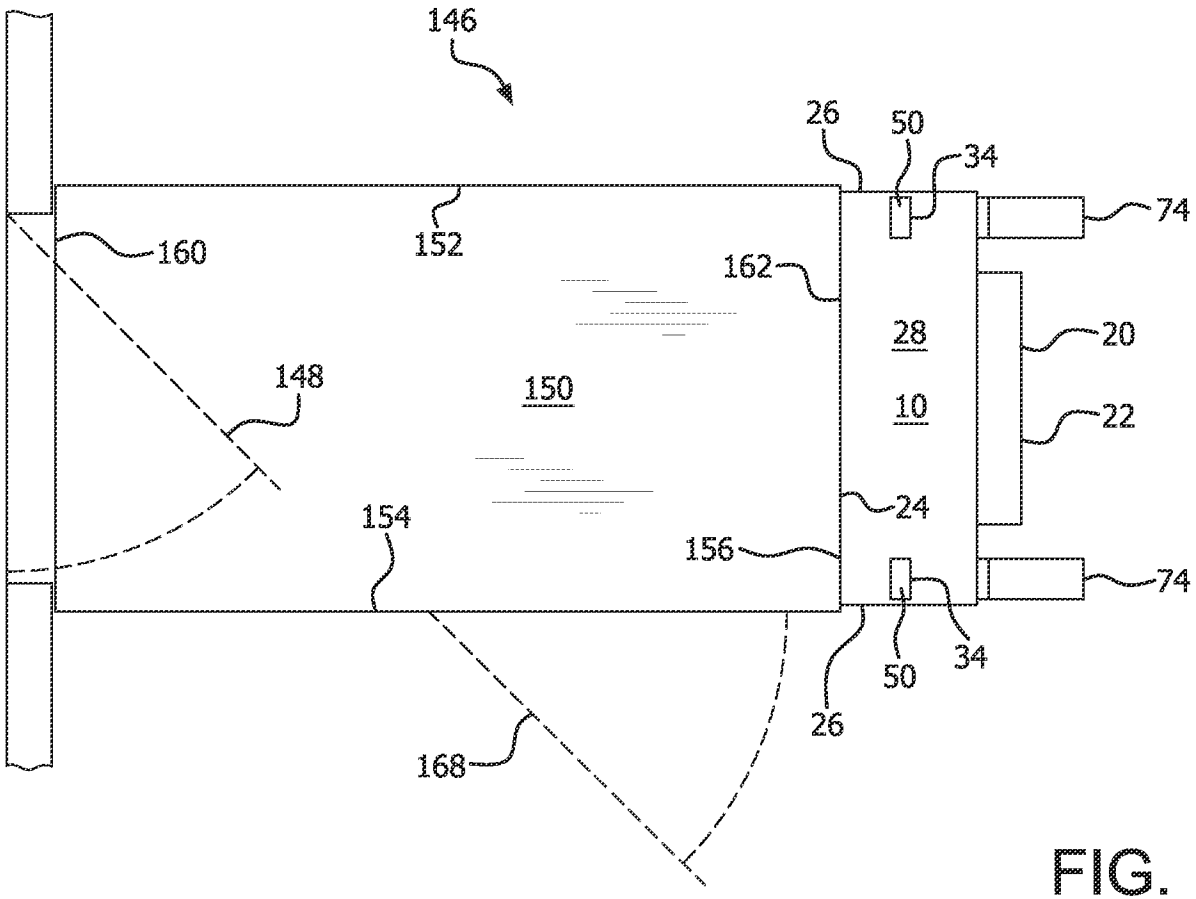
FIG. 15 is a top plan view of a walk-through duct for use with a door.
Figure 16:
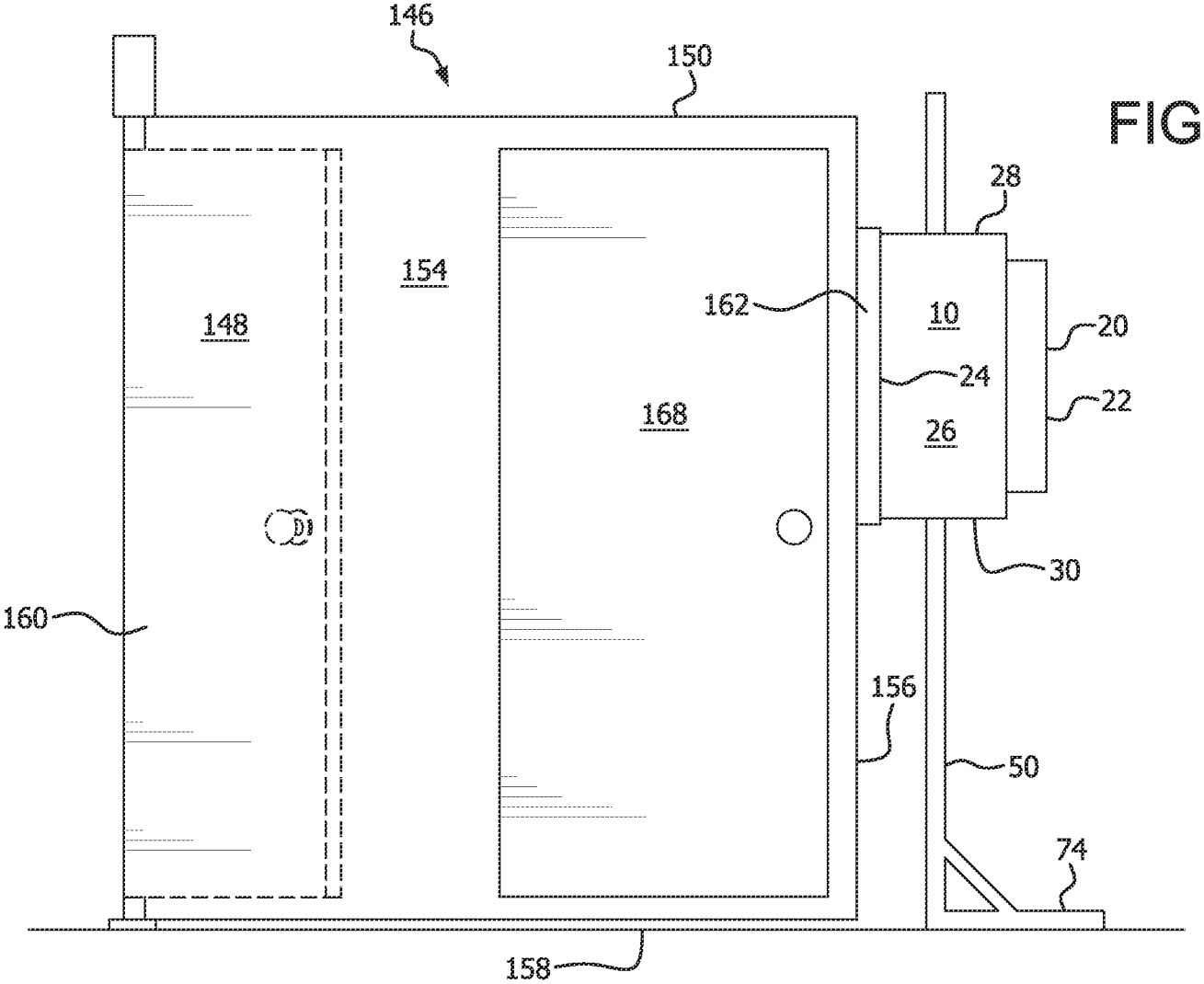
FIG. 16 is a side elevational view of the walk-through duct of FIG. 15.

FIGS. 15-16 illustrate another air duct 146 for use with a door. The air duct 146 can be used with either a sliding door 124 or with a swinging door 148. The duct 146 includes a top 150, pair of sides 152, 154, an exit panel 156, and optionally a floor 158. The entrance 160 is structured to fit around the door 148, permitting the door 148 to open into the interior of the duct 146. The exit panel 156 includes a fan interface 162 fitting around the fan 10, which in the illustrated example is supported on the legs 50. One of the walls 152, 154 includes a door 168, permitting entry and exit through the duct 146 and door 148.

Figure 17:
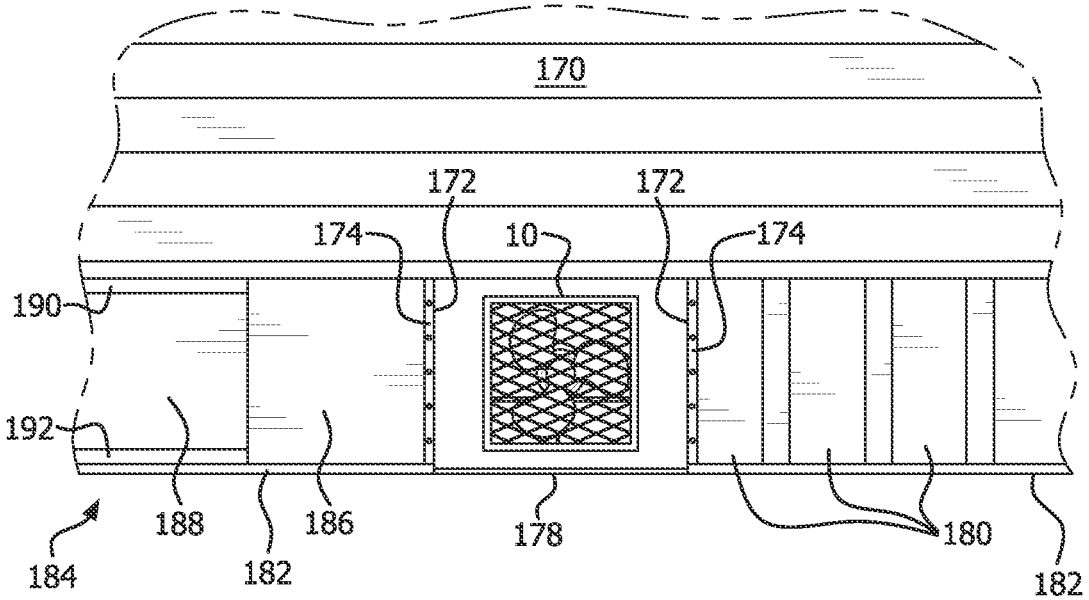
FIG. 17 is a side elevational view of an exhaust fan used in connection with an overhead door.
Figure 18:
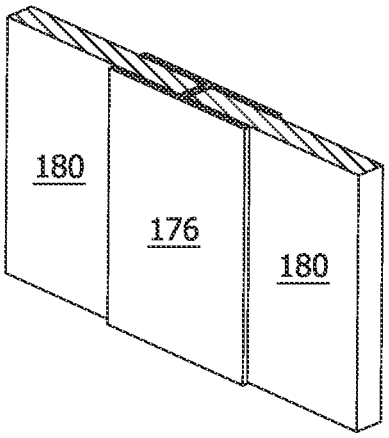
FIG. 18 is a perspective view of a pair of panels joined by an H connector.
Figure 19:
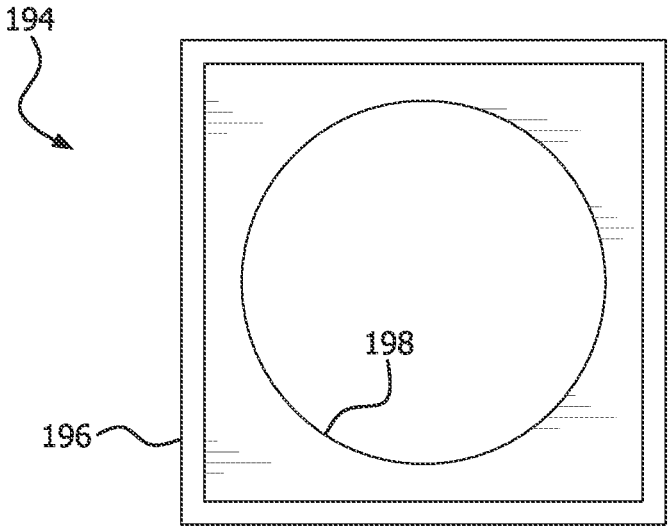
FIG. 19 is a back view of a dust collector duct for use with an exhaust fan.
Figure 20:
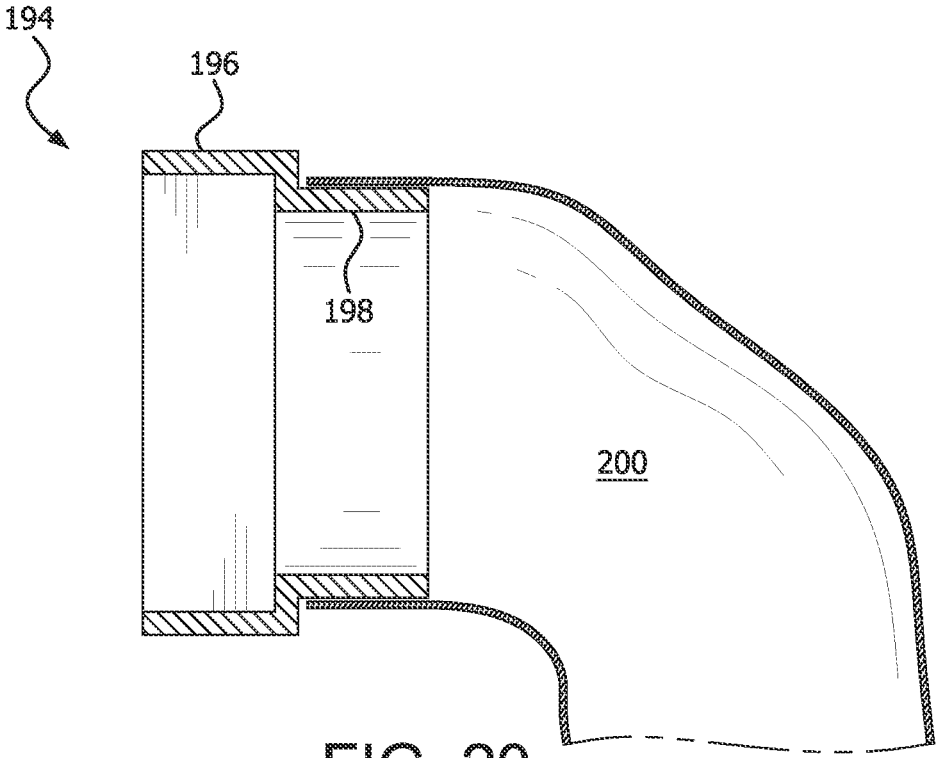
FIG. 20 is a side elevational view of a dust collector duct of FIG. 19.
Figure 21:
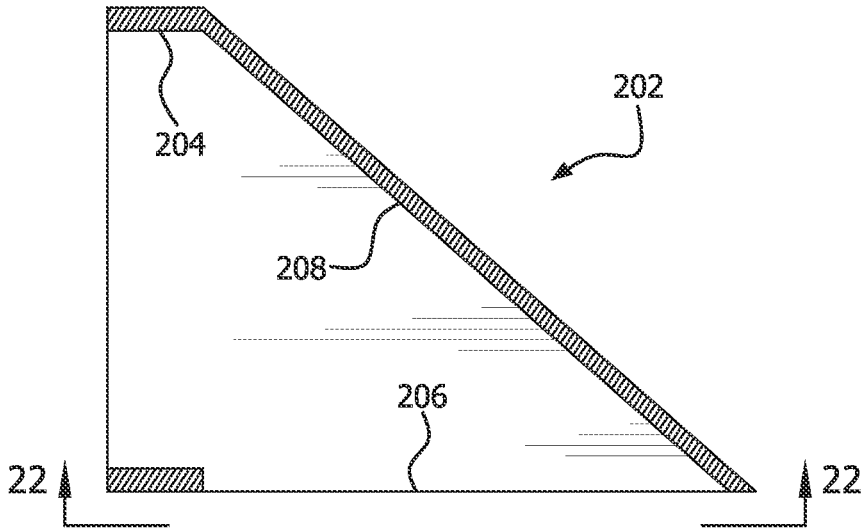
FIG. 21 is a side elevational view of a head wind shield for use with an exhaust fan.
Figure 22:
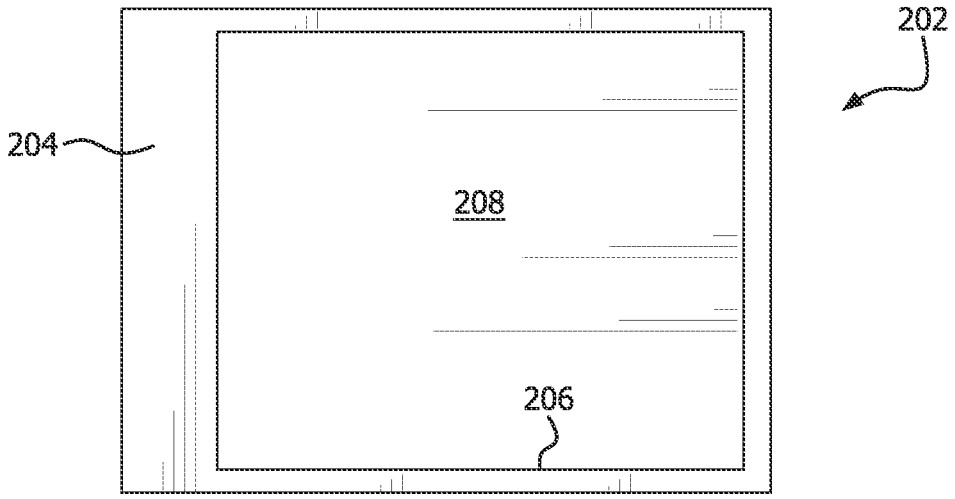
FIG. 22 is a back view of the head wind shield of FIG. 22.

Referring to FIGS. 17-18, use of the exhaust fan 10 in connection with an overhead door such as a typical garage door 170 is desirable. A collar 172 will be placed around the fan 10, with the collar 172 having a pair of side flanges 174 for connecting to H connectors 176 as well as a bottom flange 178 to cover the 2×2 inch leveling tube. The fan 10 can be placed in about the center of the overhead door 170, with the overhead door 170 being lowered to contact the top 28 of the fan 10. A rectangular panel 180 is secured to the H connectors 176 on each side of the fan 10. In the illustrated example, the H connectors are continuous, forming a substantially complete closure of the opening between the garage door 170 and the floor 182. Additional rectangular panels 180 may be secured to adjacent panels 180 using additional H connectors 176 to cover the entire width of the overhead door 170. Some examples may include an adjustable size panel assembly 184, which in the illustrated example may be placed at one end of the row of panels, 180, but may be placed anywhere within the row of panels 180 without departing from the invention. The adjustable panel assembly 184 includes a fixed panel 186 and moving panel 188 secured between a top track 190 and bottom track 192. The top track 190 and bottom track 192 are substantially equal in width to the fixed panel 186, so that moving the moving panel 188 changes the width of the panel assembly 184.

Referring to FIGS. 19-22, some examples of the exhaust fan 10 may include an attachment to the back 16 of the fan 10. Some examples include a dust collector duct 194 (FIGS. 19-20) having an entrance 196 corresponding to the back 24 of the fan 10, and an exit 198 which in the illustrated example has a diameter corresponding to the diameter of a hose 200 leading to a dust collection receptacle. Other examples may include a headwind shield 202 having an entrance 204 corresponding to the back 24 of the fan 10, and an exit 206 disposed at the bottom of the shield 202. The headwind shield 202 includes a convex curved and/or angled back panel 208 that protects the fan 10 from wind which could otherwise counter the exhausting of dust provided by the fan 10.

Figure 23:
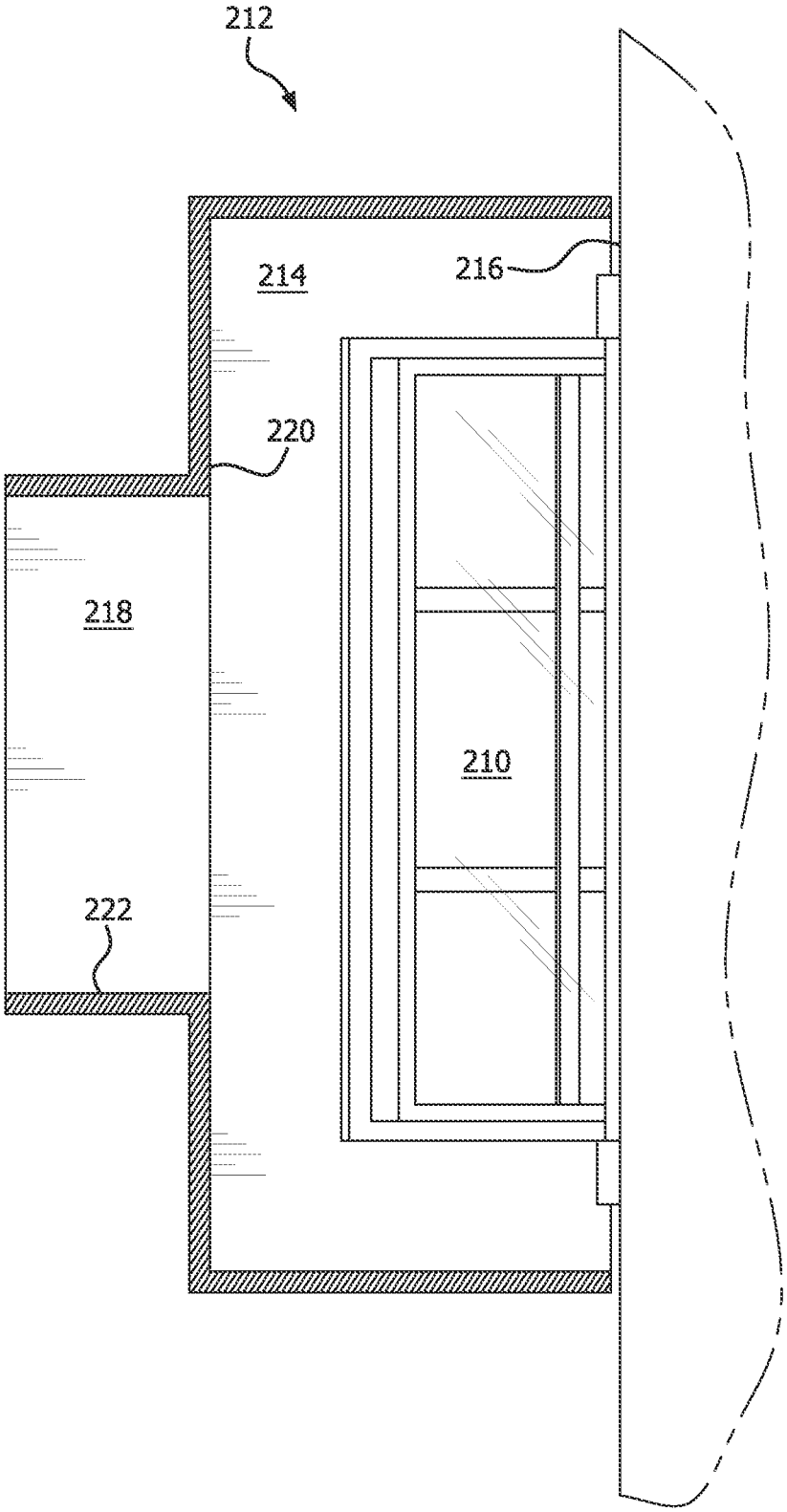
FIG. 23 is a side elevational view of a casement window duct for use with an exhaust fan.

Referring to FIG. 23, in some instances use of the fan 10 with a casement window 210 may be desired. Because casement windows 210 open outward, it is necessary to space the fan 10 sufficiently far from the window to permit opening of the window 210, while also providing a seal between the fan 10 and the window 210. The illustrated example of a casement window duct 212 includes a main body portion 214 having an open entrance side 216 which fits around the window 210. The main body portion 214 is sufficiently wide to permit opening of the casement window 210. The exit end 218 of the duct 212 includes a wall 220 defining a fan opening 222 therein. The back 24 of the fan 10 is secured within the opening 222, and may be supported by the legs 50 described above.

Figure 25:
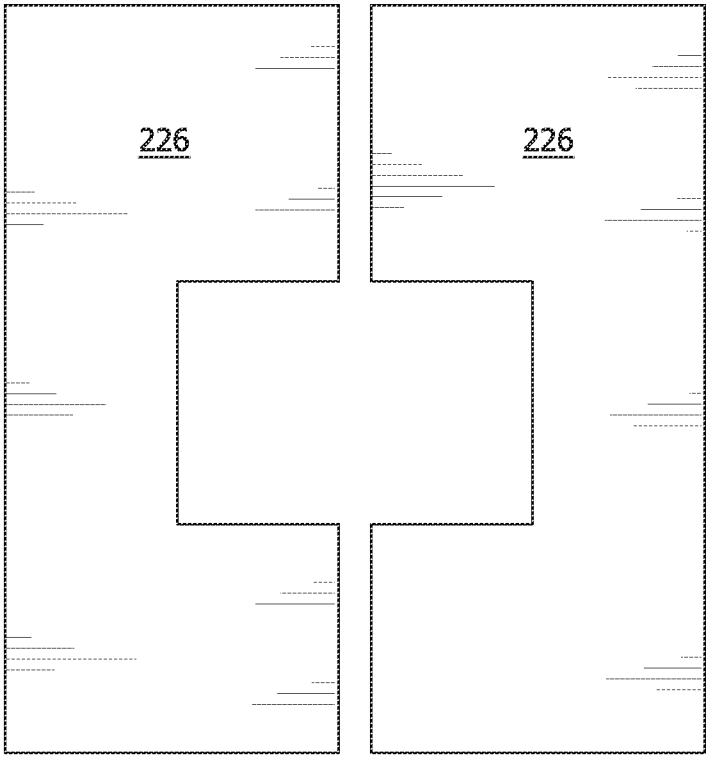
FIG. 25 is a front elevational view of the custom cut panels of FIG. 24.
Figure 24:
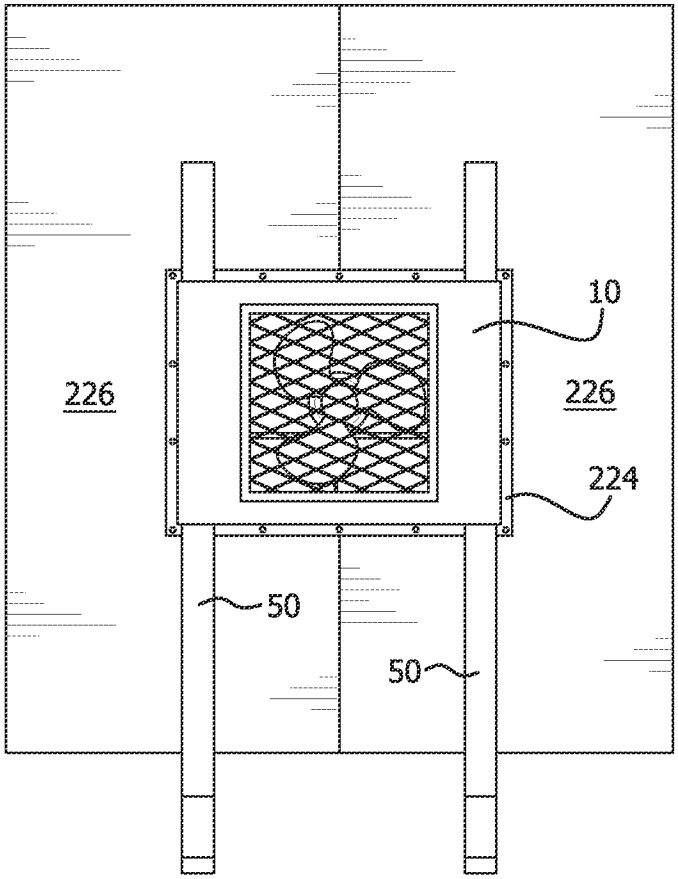
FIG. 24 is a front elevational view of an exhaust fan being used in connection with custom-cut air-shield panels for use with a large door or window opening.

Referring to FIGS. 24-25, if the fan 10 must be used with a large opening, exceeding the size of the housing of the fan 10, then a collar 224 may be placed around the fan 10, and H connectors 176 (FIG. 18) may be used to connect panels 226 that can be cut on-site to fit between the edges of the fan 10 and the edges of the opening that must be covered. The fan 10 can then be placed in a desired position with respect to the opening, using the legs 50 as described above. Air flow through the opening will therefore be restricted by the panels 226 to the air flow generated by the fan 10.

Figure 26:
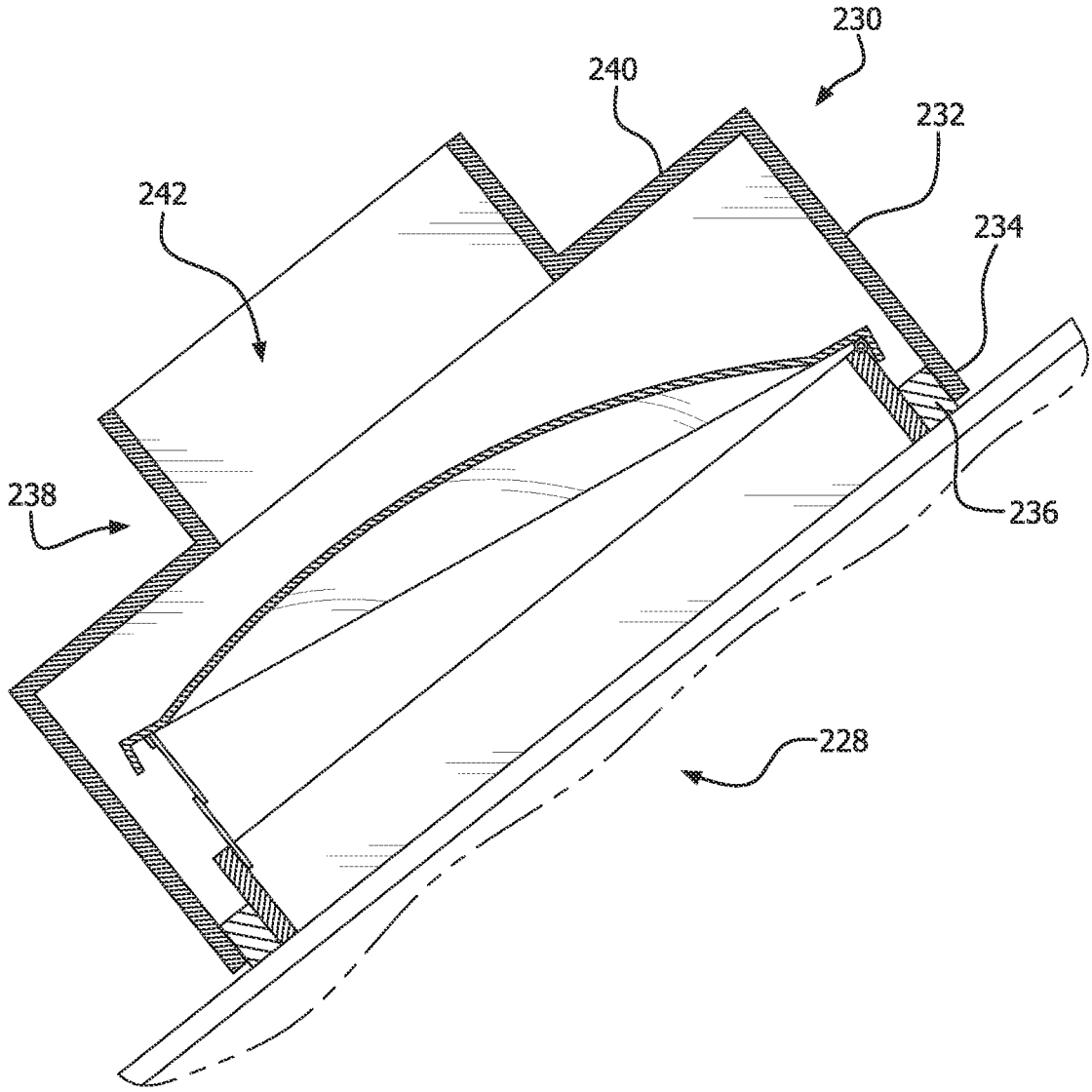
FIG. 26 is a side elevational view of a skylight duct for use with an exhaust fan.

Referring to FIG. 26, in some instances use of the fan 10 with a skylight 228 may be desired. Because skylight 228 opens outward, it is necessary to space the fan 10 sufficiently far from the window to permit opening of the skylight 228, while also providing a seal between the fan 10 and the skylight 228. The illustrated example of a skylight duct 230 includes a main body portion 232 having an open entrance side 234 which fits around the frame 236 of the skylight 228 to retain the duct 230 in position. The main body portion 232 is sufficiently high to permit opening of the skylight 228. The exit end 238 of the duct 230 includes a wall 240 defining a fan opening 242 therein. The back 24 of the fan 10 is secured within the opening 242.

Figure 27:
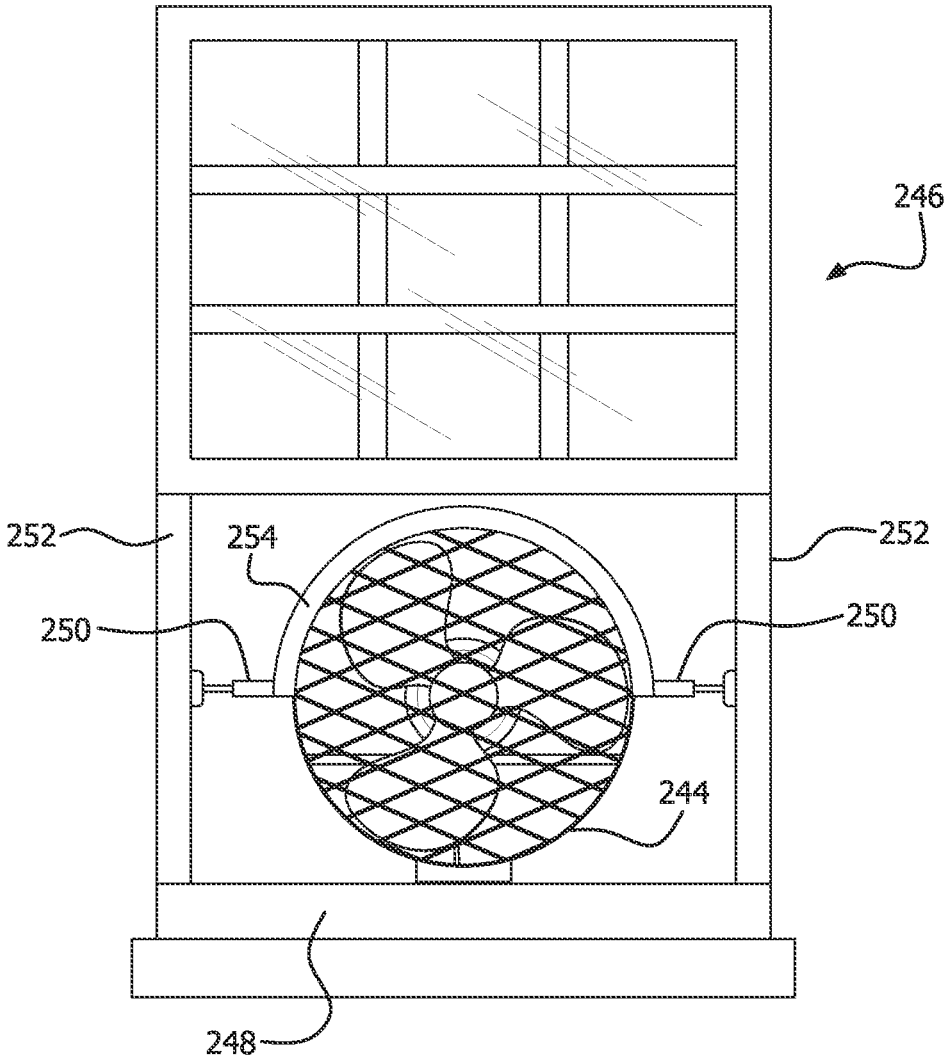
FIG. 27 is a side elevational view of an exhaust fan having an inside window mounting system.

FIG. 27 illustrates a fan 244 secured inside a window 246, resting on the window sill 248. A pair of tension mounts 250 secure against the window frame 252, holding the fan 244 in place. A shield 254 above the fan 244 protects the fan 244 from debris falling from above the fan 244.

The present invention therefore provides an exhaust fan assembly that is usable with a wide variety of presently available doors and/or windows. The adjustable height supports, along with a simple means of attaching a wide variety of air ducts to channel air and dust through the fan provide wide flexibility in exhausting dust. Security is maintained when the exhaust fan is not in use. Adequate space is provided to open a variety of doors and windows, and to enter and exit through any doors through which the exhaust fan is used.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. An exhaust kit, comprising;

a fan having a housing, the housing defining an air inlet and an air exit; and a plurality of air ducts provided as part of the kit, the plurality of air ducts including an air duct dimensioned and configured to sealingly fit a door, an air duct dimensioned and configured to sealingly fit a window, and an air duct dimensioned and configured to sealingly fit an air conditioner receptacle, each air duct being dimensioned and configured to provide an exhaust-effective seal around the air inlet of the housing.

2. The exhaust kit of claim 1, further comprising:

a collar dimensioned and configured to fit around the housing between the air inlet and air outlet, the collar having an outwardly projecting flange;

at least one panel; and at least one H-connector defining a pair of substantially parallel channels, one of the channels of the H-connector being dimensioned and configured to be secured over the outwardly projecting flange, the other of the channels of the H-connector being dimensioned and configured to be secured over an edge of the panel.

3. The exhaust kit of claim 1, further comprising:

at least one support leg;

a height-adjustment mechanism securing the housing at a predetermined height on the at least one support leg.

4. The exhaust kit of claim 1, further comprising a clamp assembly having a fan-supporting element that is structured to be secured to the housing, and a clamp that is structured to be secured to a window frame.

5. The exhaust kit according to claim 1, further comprising a pair of tension mounts provided as part of the kit, the tension mounts extending from the housing in opposing directions when the tension mounts are mounted on the housing.

6. The exhaust kit according to claim 5, further comprising a shield disposed above the housing.

* * * * *